United States Patent [19]

Soutar, Jr. et al.

[11] 4,160,307

[45] Jul. 10, 1979

[54] IMPROVEMENTS IN THERMOPLASTIC YARN REBOUND TEXTURIZING METHODS

[75] Inventors: David Soutar, Jr., Glen Burnie; Philip C. Feffer, Columbia; Lloyd M. Guenther, Severna Park, all of Md.

[73] Assignee: Chevron Research Company, San Francisco, Calif.

[21] Appl. No.: 742,085

[22] Filed: Nov. 16, 1976

[51] Int. Cl.[2] ..... D02G 1/16

[52] U.S. Cl. ..... 28/220; 28/252; 28/254; 57/208

[58] Field of Search ..... 28/1.4, 72.12, 220, 28/252, 254, 257; 57/34 B, 157 F

[56] References Cited

U.S. PATENT DOCUMENTS

| | | | |
|---|---|---|---|
| 3,026,597 | 3/1962 | Swaney | 28/1.4 |
| 3,116,589 | 1/1964 | Edwards et al. | 57/157 F |
| 3,253,396 | 5/1966 | Fish, Sr. | 28/72.12 X |
| 3,255,508 | 6/1966 | Weiss et al. | 28/257 |
| 3,273,328 | 9/1966 | Bloch | 28/72.12 UX |
| 3,381,346 | 5/1968 | Benson | 28/1.4 |
| 3,410,077 | 11/1968 | Marzocchi et al. | 28/72.12 X |
| 3,462,813 | 8/1969 | Dyer | 28/72.12 |
| 3,471,911 | 10/1969 | Nechratal et al. | 28/257 |
| 3,665,567 | 5/1972 | Clarkson | 28/72.12 X |
| 3,859,696 | 1/1975 | Guenther | 28/1.4 |
| 3,859,697 | 1/1975 | Guenther | 28/1.4 |
| 3,879,819 | 4/1975 | Guenther | 28/1.4 |
| 3,887,971 | 6/1975 | Guenther | 28/1.4 |

FOREIGN PATENT DOCUMENTS

| | | | |
|---|---|---|---|
| 242085 | 12/1962 | Australia | 28/252 |
| 651831 | 11/1962 | Canada | 28/257 |

*Primary Examiner*—Robert Mackey
*Attorney, Agent, or Firm*—Dix A. Newell; T. G. DeJonghe

[57] ABSTRACT

Improvements in thermoplastic yarn rebound texturizing method are provided by advancing a plurality of continuous filament yarns at different speeds into a stream of heated fluid advancing longitudinally of the yarns, hurling the yarns toward a foraminous surface by means of the stream of fluid while passing at least part of the stream of fluid through the surface, impinging the advancing yarns on the foraminous surface with sufficient force to induce compression crimps in the filament of at least the faster fed yarn, instantaneously rebounding the yarns from the foraminous surface, and continuously controlling the actual compaction of the yarn as it moves away from the crimping zone. The rates of advancement of the yarns respective to the fluid stream are such that at least one yarn is introduced into the system at a rate at least twice the rate of the other.

The result is a novel yarn in which the more slowly fed yarn serves as a core and the more rapidly fed yarn serves as a cover or "effect" yarn with its filaments providing rebound texturized loops protruding laterally from the core. The crimped filaments are entangled with one another and the effect yarn is entangled with the core to give the yarn product stability and integrity, permitting it to be processed into fabrics and the like on conventional equipment. An additional slub yarn effect may be achieved by slowing the core yarn feed, thus periodically forming overfed yarn slubs or nodules on the effect yarn product.

10 Claims, 2 Drawing Figures

IMPROVEMENTS IN THERMOPLASTIC YARN REBOUND TEXTURIZING METHODS

BACKGROUND OF THE INVENTION

This invention relates to improvements in rebound texturizing or bounce crimping of thermoplastic multifilament yarns.

The synthetic textile industry is greatly interested in texturizing synthetic thermoplastic continuous filament yarns. As produced, these yarns are relatively straight and have little bulk. It is desired that they be bulked, so that the yarns resemble more closely yarns spun from staple fiber. Customarily, these yarns are bulked by bending or crimping the individual filaments in the yarn and heat setting the yarn while the filaments are bent or crimped.

Fluid under pressure has been used extensively in the texturizing of synthetic thermoplastic yarns. See, for example, U.S. Pat. Nos. 3,097,412 and 3,373,470.

A basic advance in the texturizing of thermoplastic yarn was a technique known as a rebound or bounce crimping process which yields strikingly improved results as far as crimp quality is concerned.

Bounce crimping entails hurling yarn, by a heated fluid, through a jet in a continuous stream-like flow against a foraminous surface upon which the yarn impinges and from which the yarn instantaneously rebounds or bounces. The impact upon the foraminous surface axially buckles and crimps individual filaments of the yarn while the heated fluid passes through the foraminous surface. The texturized yarn without tension and substantially by rebound interia progresses away from the crimping zone and is retained in an essentially tensionless state until the crimp has set. Then the yarn is wound upon a storage spool or package.

Thermoplastic yarn texturized by the foregoing bounce crimping process possesses, among other things, exceptional covering capability and a high degree of resiliency as disclosed in Miller et al U.S. Pat. No. 3,686,848, issued Aug. 29, 1972.

The basic process and apparatus for practicing the process is featured in Clarkson U.S. Pat. No. 3,665,567 issued May 30, 1972. In brief summary, the Clarkson structure entails feeding a yarn through a tubular passage by a jet of steam and hurling the yarn longitudinally against a foraminous screen. The yarn is thereby crimped or texturized and rebounds laterally through a passage from which it drops down to a receiver for heat setting. The steam primarily passes through the foraminous screen and is collected, although some of the steam may pass laterally through the yarn outlet passage along with the texturized yarn.

Notwithstanding singular advantages provided the synthetic textile industry by the above-noted Clarkson bounce crimping process, room for significant advances remains.

For example, the bounce crimped yarns known heretofore have not been used widely or at all in some of the specialty yarn markets and the production of more voluminous yarns containing bounce crimped filaments wound result in an even greater area of utility in the textile industry.

SUMMARY OF THE INVENTION

Accordingly, a primary object of the present invention is to provide improvements in thermoplastic yarn rebound texturizing methods and products.

Another more particular object of the present invention is to provide methods for producing more voluminous rebound texturized or bounce crimped yarns.

Yet another object of the present invention is to produce rebound texturized or bounce crimped yarns of greater utility in the textile industry.

In accordance with one aspect of the present invention, an improved rebound texturizing or bounce crimping method is provided. The general method includes (a) longitudinally advancing first and second thermoplastic multifilament yarns in a stream of heated fluid advancing longitudinally of the yarns, the first yarn being advanced at a rate at least twice the rate of advance of the second yarn; (b) hurling the yarns toward a foraminous surface by means of the stream of fluid while passing at least part of the stream of fluid through the foraminous surface; (c) impinging the advancing yarns on the foraminous surface with sufficient force to induce compression crimps in the filaments of at least the first yarn; (d) instantaneously rebounding the yarns from the surface in a continuous strand-like stream, the filaments of the first yarn being entangled with each other and the first yarn being entangled with the second yarn, the filaments of the first yarn protruding laterally from the second yarn in loop configurations of rebound texturized filament sections; and (e) guiding the entangled rebounded yarn away from the foraminous surface in a generally tensionless state.

In this process, the slower fed yarn becomes a core and the faster fed yarn becomes a cover in the completed product which is of the type referred to in the trade as an effect yarn product. Although such a product is a unitary yarn, the core is sometimes referred to generally as a core yarn and the cover is sometimes referred to generally as an effect yarn. Since the lengths of the cover filaments contained in a given length of product must necessarily be much greater than the lengths of core yarn filaments there, these extra lengths of cover yarn filaments must be oriented laterally with respect to the axis of the yarn. The arrangement may be visualized generally as one in which rebound texturized loop portions of cover yarn filaments protrude laterally from the assembly of core yarn filaments all along the length of the product.

In the products of this invention, the filaments of the cover or effect yarn are crimped and they are entangled not only with the other filaments of the cover yarn but also in varying degrees with filaments of the core yarn. The filaments of the core yarn are also entangled in varying degrees with each other and the filaments of the cover or effect yarn, and they may be individually crimped, although the degree of crimp in the core yarn filaments may be rather small in some instances. The effect yarn is also in varying degrees entangled with or wrapped around the core yarn. In the overall products of the invention, the filaments are so locked in by these entanglements that unitary yarn structures are provided, susceptible of being handled satisfactorily by conventional textile fabric making machines. In other words, the combination of the different entanglements and the bounce crimping provide an intimate and substantially immobile relationship between the effect yarn and the core yarn such that there is essentially no slippage of the effect yarn on the core yarn. This is highly desirable for textile operations.

In another aspect of the present invention, a slub yarn effect is also achieved by slowing, either regularly or randomly, the core yarn feed so that slubs or nodules of overfed effect yarn also appear on the final product.

Control over the character of the yarns produced may also be exercised by controlling other aspects of the process and the inputs to the process.

For example, the input yarns may vary as to number, composition, overall size, and filament size and shape.

In accordance with another aspect of the present invention, it has been found that increasing the speed of the effect yarn or cover yarn decreases the entanglement of the effect yarn with the core yarn.

It has also been found that input yarn filament size has a noticeable effect on the degree of entanglement achieved in the process, and that, in general, the lower the denier per filament, the better the entanglement will be.

Further, the overfeed ratio has been found to have a gross and pronounced effect on overall yarn product bulk and denier. The greater the overfeed ratio, the greater will be the lengths of effect yarn filament loops or increments which must protrude laterally from the core and the greater will be the number of loops or increments per unit length to provide enhanced volume, compaction and bulk, and the greater will be the denier (weight per unit length) of the yarn product.

Moreover, it has been found that increased restriction or resistance on the texturized yarn emerging from the actual crimping zone or chamber increases entanglement of the effect yarn with the core yarn and entanglement of the effect yarn with itself. In practice this restriction or controlling of axial compaction is imposed by resistance forces applied downstream from the actual crimping zone or chamber to inhibit discharge of yarn product. The physical results of increased restriction is the increased entanglement of the effect yarn filaments both with the core yarn filaments and also with other effect yarn filaments. This latter effect contributes to the visual indication of a compact yarn.

Other objects, aspects and advantages of the present invention will become apparent to one skilled in the art in view of the following description of the preferred embodiments when read in conjunction with the accompanying drawings.

DESCRIPTION OF THE PREFERRED EMBODIMENTS

The improvement of the subject invention is with respect to rebound texturizing or bounce crimping generally according to the above referenced U.S. Pat. Nos. 3,665,567 and 3,686,848, as well as U.S. Pat. Nos. 3,859,696; 3,859,697 and 3,887,971, all of which are assigned to the assignee of the present invention. The entire disclosure of these patents are hereby incorporated by reference as though set forth at length.

Figure 1:
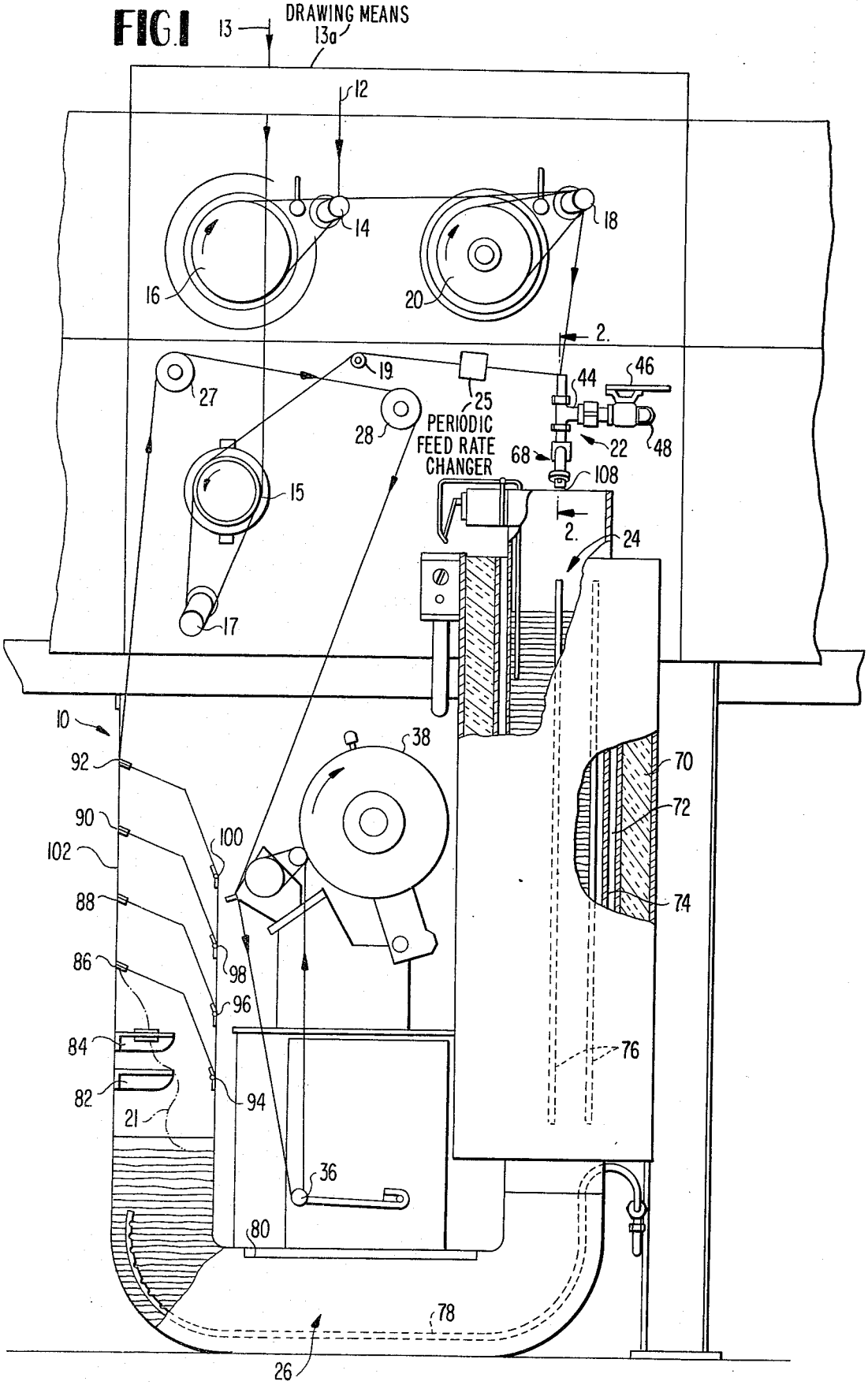
FIG. 1 is a front elevational view, partially broken away, of a bounce crimping apparatus for texturizing synthetic thermoplastic continuous filament yarns.

Briefly, however, the basic bounce crimping of the subject invention may be appreciated by reference to FIG. 1 which discloses an elevational view, partially broken away, of a bounce crimping apparatus 10.

A first multi-filament synthetic thermoplastic effect yarn 12 is fed from a supply package (not shown) to a first driven godet roll 16 with skewed separator roll 14 and then to a second driven godet roll 20 with skewed separator roll 18. Godet rolls 16 and 20 may be heated and rolls 18 and 20 advance the yarn at a much greater speed than do rolls 14 and 16 so that the yarn 12 is drawn between the two sets of rolls. From roll 18 the effect yarn 12 advances to a yarn texturizing station indicated generally by reference character 22.

A second pre-drawn multi-filament synthetic thermoplastic core yarn 13 is fed from a supply package (not shown) to a driven godet roll 15 and about a skewed separator roll 17 and a roll 19 to the texturizing station 22. The second yarn 13 may also pass through a suitable conventional means 25 to cause a periodic slowing in advancement of the second yarn. The frequency and duration of the retardation induced by the means 25 may be random, as desired. Instead of using pre-drawn core yarn, undrawn core yarn may be used, for example, utilizing a drawing means 13*a* shown schematically but which is a draw roll arrangement similar to the draw rolls 14, 16, 18, 20 drawn for the effect yarn 12. The texturized product yarn passes from texturizing station 22 into a heating chamber 24 where the yarn is heated in a loose mass substantially free from tension. The yarn passes downstream of the heating chamber 24 into a cooling chamber 26 in the form of a strand over idler rolls 27, 28 and advances over idler roll 36 to a standard takeup mechanism where the yarn is wound in a package 38 for storage and shipment.

Figure 2:
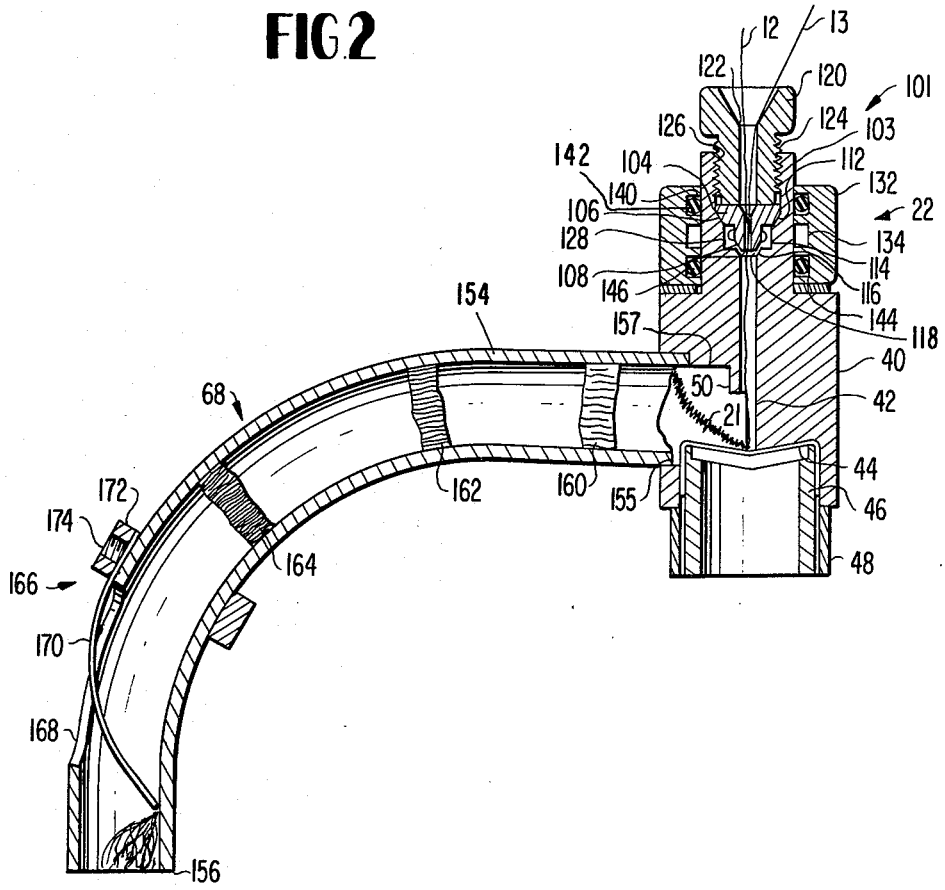
FIG. 2 is a cross sectional view taken along section line 2—2 in FIG. 1 and discloses a bounce crimping chamber and lateral outlet tube according to a preferred embodiment of the invention.

Referring to FIG. 2 the yarn texturizing station 22 includes an adapter housing 40 having a longitudinally extending central bore 42. The external lower end of the adapter housing 40 is fashioned with a convex configuration surrounding the bore 42. A member 44 having a foraminous surface, such as a screen, closes the lower end opening of the bore 42 to the passage of yarn while simultaneously permitting steam to longitudinally pass through the openings in the screen 44.

The adapter housing 40 is fitted with a coaxial collar 46 which serves as an adapter for connection of the bore 42 with a steam exhaust conduit 48. By the provision of the exhaust conduit, steam passing through the screen 44 may be drawn off by a blower (not shown).

The above described texturizing station 22 serves to texturize or crimp thermoplastic yarn by the technique of "rebound" or "bounce" crimping. In this connection, thermoplastic yarns 12, 13 are drawn into the texturizing station, heated by steam and advanced into the bore 42 by an improved orifice and steam introduction assembly to be discussed in detail hereinafter. As the live process steam picks up the yarns 12, 13 it hurls the yarns longitudinally with great force downwardly through the bore 42 toward the screen 44 at a centermost point of the concave portion of the screen. The bulk of the steam passes through screen 42 while the composite yarn rebounds or bounces from the screen 44 instantaneously in a continuously moving strand-like stream 21 flowing upwardly and to the left, past a relatively thin side wall 50 within the adapter housing and into a lateral exit opening. From the improved conveying and compacting means 68 the yarn 21 is deposited into the heating chamber 24. Instead of steam, other heated fluids under pressure may be used. For example, heated compressed air or nitrogen may be used.

as noted in FIG. 1, the heating chamber 24 consists of an outer sleeve of insulation 70 which surrounds a steam chamber 72, which in turn encompasses an inner cylindrical yarn treating chamber 74. Steam is circulated through chamber 72 to heat the wall about the yarn treating chamber 74, and consequently to heat the yarn contained within the chamber 74.

The rebounded texturized yarn 21 falls into the yarn receiving chamber 74 in a condition substantially free of longitudinal tension. As the yarn 21 is withdrawn from the cooling chamber 26 by the takeup mechanism, the loose mass of yarn within the heating chamber 24 progresses downwardly through the heating chamber.

To further assist in heating the yarn within chamber 74, hot air bleed tubes 76 are disposed vertically within the chamber 74 and are provided with apertures spaced at regular intervals throughout the longitudinal extent thereof. Air heated in the steam chamber 72 is blown from the apertures within bleed tubes 76 into chamber 74 to circulate through the mass of yarn within the chamber 74 and insure uniform heating of the texturized yarn.

As previously noted, immediately beneath the heating chamber 24 there is disposed a cooling chamber 26 comprising the bottom leg of a J-tube formed by the heating chamber 24 and the cooling chamber 26. The yarn passes through the cooling chamber 26 still in a loose untensioned mass. To assist in cooling the yarn, two air bleed tubes 78 are disposed inside and on opposite sides of the cooling chamber 26. Air at room temperature is blown through the cooling tubes 78 and out through apertures within the tubes along the longitudinal length thereof to circulate through the yarn mass to cool the yarn and exit through an opening 80 within a top portion of the cooling chamber 26.

Not until this point when the yarn has been fully heat set and cooled is the texturized yarn subject to longitudinal tension. As noted in FIG. 1, the yarn 21 is now withdrawn from the cooling chamber 26 over a baffle 82 and through an eyelet 84 which tends to remove loose tangles in the yarn. To further remove any loose tangles a series of tension vanes 86, 88 90 and 92 are provided. These vanes are simply thin pieces of sheet metal shaped to close the chamber and pivot at hinges 94, 96, 98 and 100, respectively, so that gravity will pivot the tension vanes against a wall 102 of the chamber.

The effect yarn 21 then advances in a substantially linear form over idler rolls 27, 28 and 36 to be wound upon a package 38 in a conventional manner as previously noted.

As specifically illustrated in FIG. 2, a jet texturizing apparatus 101 forming a part of the yarn texturizing station 22 is disclosed. The jet texturizing apparatus 101 includes an upwardly projecting cylindrical portion 103 of the yarn texturizing adapter housing 40 and a readily replaceable orifice member or plug 104 coaxially positioned within the interior of the cylindrical projection 103.

The orifice plug 104 includes a central longitudinally extending passage 122 operable for receiving yarns 12, 13. The plug 104 is further fashioned with a first frustoconical exterior surface 106 adjacent an upper end thereof and a second frustoconical surface 108 adjacent a lower end of the orifice plug. A conical extension of the first frustoconical surface 106 is spaced from a conical extension of the second frustoconical surface 108 by a small distance. This spacing operably forms an annular steam jetting orifice in a manner to be discussed hereinafter.

The replacement orifice plug 104 is designed to be coaxially received within the extension 103 of the yarn texturizing housing wherein the first frustoconical surface 106 of the orifice plug intimately mates with a first frustoconical ledge 112, machined upon an interior surface of the cylindrical projection 103. A cylindrical bore 114 is machined into the projection and terminates into a second frustoconical ledge 116 lying upon an extension of the conical surface of ledge 112. The second frustoconical ledge 116 provides a smooth transition between the bores 114 and 42.

The axial extent of bore 114 is designed with respect to the axial extent of the orifice plug 104 such that the second frustoconical surface 108 of the plug lies in a mutually adjacent but spaced posture with respect to the second frustoconical ledge 116. The small spacing provided between the second frustoconical surfaces 108 and 116 at 118 provides an annular aperture or orifice for the uniform introduction of steam into the bore 42.

The orifice plug 104 is rigidly held within the projecting cylindrical extension 103 of the yarn texturizing housing 40 by the provision of a backing plug 120 having a central longitudinal aperture 122 for guiding thermoplastic yarns 12, 13 into the orifice. Exteriorly the plug 120 is provided with threads 124 which mate with interior threads 126 fashioned upon the internal surface of the extension 103. By the provision of this threaded engagement, the plug 103 may be tightly torqued down to abutting engagement with the orifice plug 104 to securely and rigidly mount the first and second frustoconical surfaces 106 and 112 in mating engagement.

When the orifice plug 104 is mounted in an operative position, as illustrated in FIG. 2, within the bore 114 of the texturizing housing extension 103, an internal or first process steam plenum chamber 128 is formed. This internal plenum chamber 128 is defined by the bore 114 of the extension 103, an external cylindrical surface of the orifice plug 104, the first frustoconical surfaces 106 and 112 and the second frustoconical surfaces 108 and 116. This internal steam plenum chamber 128 is operable to uniformly deliver steam through the annular orifice at 118 and without producing an undesired erratic and/or swirling flow.

Referring now specifically to FIG. 2 a heated fluid adapter is disclosed and is designed to be received upon the texturizing housing extension 103 at an elevational location coincident with that of the orifice plug 104. The heating fluid adapter unit includes an annular housing 132 having a central annular bore 134 which forms in combination with the exterior surface of the yarn texturizing housing 103 a steam plenum chamber exterior of the housing.

Steam is delivered into plenum chamber through an adapter fitting (not shown) of a conventional design which is connected to a source of live process steam through a regulator valve (not shown).

The annular housing 132 is further provided with an upper annular chamber 140 which receives a first sealing O-ring 142 and a lower annular chamber 144 for receiving a second sealing O-ring 146. The upper and lower sealing assemblies serve to sealingly engage the exterior surface of the texturizing housing extension 103 and prevent the passage of steam from the plenum chamber into the ambient environment.

A plurality of apertures are radially fashioned through the texturizing housing extension 103 and serve to fludically communicate the exterior steam plenum chamber and the interior steam plenum chamber 128 between the orifice plug 104 and the bore 114, as previously noted.

As specifically illustrated in FIG. 2, an outlet and compaction means 68 comprises a cylindrical tube 154 having a circular cross section and is designed to normally extend at a first end 155 into and mate with the adapter body 40. In this connection, a central longitudinal axis of the tube 154 at the first end 155 will intersect and lie at right angles to the central longitudinal axis of the bore 42 of adapter 40. The other end 156 of the outlet tube is bent downwardly approximately 90° with respect to the first end such that the central longitudinal axis of the tube at the second end extends at a right angle with respect to the central longitudinal axis of the tube at the first end thereof.

The internal diameter of the circular tube 154 is slightly greater than an arcuate upper surface 157 of a lateral outlet arch fashioned within the adapter 40. Accordingly, texturized yarn 21 rebounding from the foraminous surface 44 smoothly enters the outlet tube 154 without becoming tangled by sharp edges or corners between the outlet tube 154 and the adapter housing 40. This smooth transition zone minimizes the occurrence of a blocking or jamming tendency of the texturized yarn 21 at the outlet of the adapter 40.

The internal cross sectional area of the tube 154 is not vastly greater than that of the adapter yarn outlet opening defined by the screen 44 at the bottom and the arch 157 at the top. This feature is important in that it has been found desirable to inhibit buckling of the yarn back and forth upon itself as the yarn moves along the tube 154. The rebounding yarn from the crimping zone tends to assume the general size and shape of the adapter outlet opening, and if this is very much smaller than the passage into which the yarn is moving there is a tendency for buckling along the length of the yarn to cause yarn to eject intermittently and to produce irregularities in the product. It has been found that such difficulties may be avoided if the internal cross sectional area of the tube 154 is in the range of from about 1½ to about 2 times the area of the adapter outlet opening. Under these conditions, there is little tendency for lateral buckling of the yarn; instead it may compress axially to substantially fill the cross sectional area of the tube 154 so that reshaping of the filament assembly takes place smoothly and regularly.

The arcuate, approximately 90°, bend in the outlet tube 154 provides resistance to the passage of texturized yarn 21 through the tube. In this connection, as the yarn 21 encounters increased resistance provided by the curve in outlet tube 154, the yarn increases in axial compaction as schematically represented at points 160, 162 and 164. The outlet tube 154 progressively imparts axial compaction of the texturized yarn 21 to provide a loose plug of crimped fibers. This axial compression downstream of the crimping chamber facilitates the overall yarn texturizing process and desirable entanglement of the effect yarn as discussed above.

This advantageous axial compression of the texturized effect yarn 21 within the outlet tube may be enhanced yet further by the provision of back pressure apparatus 166 positioned adjacent the outlet end of the tube 154. More particularly, the tube 154 may be fashioned with an oblong opening or slot 168 in the surface thereof for permitting the entrance of a leaf spring 170. The spring 170 is mounted upon the tube 154 by a mounting collar 172 and set screw 174.

The leaf spring 170 extends within the tube 154 substantially across the axial passageway thereof and facilitates the back pressure maintaining character of the outlet tube as initially provided by the arcuate configuration thereof. The back pressure provided by leaf spring 170 further adds axial compaction to the yarn as it progresses in a loose mass through the outlet tube 154 and falls into the heat treating chamber 24.

The presence of the spring 170 is particularly advantageous from the standpoint of enhancing the versatility of the apparatus. Where different sizes of yarns are to be processed, the resistance to movement offered by the bent tube alone may vary significantly in dependence upon the size of the yarn, but the spring 170 tends to make reasonably uniform the overall resistance to passage of the composite yarn. The spring is very light in weight, so that its inertia characteristics do not contribute significantly toward the production of gross nonuniformities in the yarn being processed.

Although much of the description herein focuses on processes and resulting product yarns where there are only two input yarns to the bounce crimping apparatus, other effects can be achieved by using more than two yarns.

Input yarn filament shape has some effect on crimp, with shapes other than round cross-sections frequently exhibiting more pleasing textures.

Any synthetic thermoplastic multifilament yarn may be used according to the present invention. These include polyolefins, e.g., polypropylene; polyamides, e.g., poly(caprolactam); poly(2-pyrolidone) and poly(hexamethylene adipamide); polyesters, e.g., polyethylene terephthalate; acrylics, e.g., polyacrylonitrile; and cellulose esters, e.g., cellulose acetate. The effect and core yarns may be of one or more of these materials, and the materials of the effect and the core yarns may be the same or different. Polyolefins and polyamides may give particularly pleasing effects.

The thermoplastic multifilament yarns may be drawn or undrawn prior to texturizing. Preferably when polypropylene is used, the yarn is drawn at a suitable ratio, e.g., between about 2:1 and 5:1.

As indicated above, the cover or effect yarn is fed or advanced to the texturizing zone at a rate of at least twice that of the core yarn. Overfeed ratios of effect yarn to core yarn may be much higher, e.g., 100:1. More typically, and preferably herein, the overfeed ratio is between about 5:1 and 50:1.

The speed of the effect yarn as it is fed to the texturizing zone may vary considerably. Typically, the speed of the input effect yarn to the texturizing chamber may be between about 1,000 and about 10,000, typically between about 3,000 and about 6,000 feet per minute.

EXAMPLES

Using the apparatus and method described above in connection with FIGS. 1 and 2, a number of novel effect yarns were produced according to the present invention. (A 50 mesh screen was used in the texturizing chamber.) Data for the runs is given in the TABLE below.

TABLE

| Example | 1 | 2 | 3 | 4 | 5 | 6 | 7 | 8 |
|---|---|---|---|---|---|---|---|---|
| Draw ratio (rolls 20,18: | 3:1 | 3:1 | 3:1 | 3:1 | 3:1 | 3:1 | 3:1 | 3:1 |

TABLE-continued

| | | | | | | | | | |
|---|---|---|---|---|---|---|---|---|---|
| rolls 16,14) | | | | | | | | | |
| Effect yarn speed (ft/min) | 3600 | 4320 | 2475 | 3090 | 4350 | 4350 | 4350 | 4350 | |
| Roll (16) steam (psi) | 12.4 | 12.4 | 12.4 | 12.4 | 12.4 | 12.4 | 12.4 | 12.4 | |
| Texturizing chamber steam (psi) | 100 | 100 | 100 | 100 | 100 | 100 | 100 | 100 | |
| Effect yarn polymer (12) | PP[1] | PP | PP | PP | PP | PP | PP | PP | |
| Core yarn polymer (13) | PP | PP | PP | PP | PP | PP | PP | PP | |
| Restrictor (170) | No | No | No | No | Yes | No | Yes | Yes | |
| Feed ratio[2], effect yarn: core yarn | 5.1:1 | 28.1:1 | 9.2:1 | 9.4:1 | 7.8:1 | 7.8:1 | 2.9:1 | 5.2:1 | |
| Denier of effect yarn (12) | 900/70[3] | 900/70[3] | 900/70[3] | 900/70[3] | 600/140 | 600/140 | 600/140 | 600/140 | |
| Denier of core yarn (13) | 400/70 | 300/70 | 400/70 | 400/70 | 400/70 | 400/70 | 400/70 | 400/70 | |
| Example | 9 | 10 | 11 | 12 | 13 | 14 | 15 | 16 | 17 |
| Draw ratio (rolls 20,18: rolls 16,14) | 3:1 | 3:1 | 3:1 | 3:1 | 3.5:1 | 3.5:1 | 3:1 | 3:1 | 3:1 |
| Effect yarn speed (ft/min) | 5334 | 5334 | 5334 | 4350 | 4317 | 4317 | 4350 | 5334 | 4320 |
| Roll (16) steam (psi) | 12.4 | 12.4 | 12.4 | 12.4 | 12.7 | 12.7 | 12.4 | 12.4 | 12.4 |
| Texturizing chamber steam (psi) | 100 | 100 | 100 | 100 | 100 | 100 | 100 | 100 | 100 |
| Effect yarn polymer | PP | PP | PP | PP | PA | PA | PP | PP | PP |
| Core yarn polymer | PP | PP | PP | PP | PA[4] | PA | PP | PP | PP |
| Restrictor (170) | No | No | No | No | Yes | No | No | No | Yes |
| Feed ratio, effect yarn:core yarn | 13.3:1 | 16.8:1 | 22.2:1 | 10.6:1 | 27.2:1 | 27.2:1 | 10.6:1 | 10.7:1 | 23.4:1 |
| Denier of effect yarn | 600/140 | 600/140 | 600/140 | 550/140 | 1800/140 | 1800/140 | 600/140 | 600/140 | 1300/70[5] |
| Denier of core yarn | 400/70 | 400/70 | 400/70 | 400/70 | 1100/104 | 1100/140 | 400/70 | 400/70 | 400/70 |

[1]PP=Polypropylene

[2]Feed ratio calculated as equal to: $\frac{\text{Effect roll (20) speed}}{\text{Core roll (15) speed}}$

[3]3 × 300/70 yarn (all deniers aproximate)

[4]PA=Polyamide (nylon 66)

[5]900/70 plus 400/70 yarns

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

We claim:

1. A method of producing a thermoplastic multi-filament effect yarn, which method comprises:

(a) advancing first and second multi-filament yarns longitudinally of themselves in a stream of heated fluid advancing longitudinally of the yarns in a bounce crimper unit, the first yarn being advanced at a rate at least twice the rate of advance of the second yarn;

(b) hurling the yarns toward a foraminous surface within the bounce crimper unit by means of the stream of fluid while passing at least part of the stream of fluid through the foraminous surface;

(c) impinging the advancing yarns on the foraminous surface with sufficient force to induce a compression crimp in the filaments of at least the first yarn;

(d) instantaneously rebounding the yarn from the surface in a continuous strand-like stream into a laterally extendig zone within the bounce crimper unit, the filaments of the first yarn in said zone being entangled with each other and the first yarn being entangled with the second yarn, with filaments of the first yarn protruding laterally in loop configurations of bounce crimped filament sections; and (e) delivering the entangled rebounded yarn away from said zone and out of said unit without tensioning the yarn and while controlling the axial compression of the body of yarn exiting said zone.

2. A method according to claim 1 further comprising periodically slowing advancement of the second yarn in step (a) to cause periodic greater overfeed of the first yarn and resulting in periodic concentrations of the first yarn spaced along lengths of the entangled rebounded yarn.

3. A method according to claim 2 wherein the frequency and duration of the slowing are made randomly.

4. A method according to claim 1 wherein the first yarn is selected from the group consisting of polypropylene and polyamide and prior to step (a) is drawn at a draw ratio between about 2:1 and 5:1.

5. A method according to claim 4 wherein the second yarn is selected from the group consisting of polypropylene and polyamide.

6. A method of producing a thermoplastic multi-filament effect yarn, which method comprises:

(a) advancing first and second multi-filament yarns longitudinally of themselves in a stream of steam advancing longitudinally of the yarns in a bounce crimper unit, the first yarn being advanced at a rate of between about five and about fifty times the rate of advance of the second yarn;

(b) hurling the yarns toward a foraminous surface within the bounce crimper unit by means of the stream of steam while passing at least part of the stream of steam through the foraminous surface;

(c) impinging the advancing yarns on the foraminous surface with sufficient force to induce a compression crimp in the filaments of at least the first yarn;

(d) instantaneously rebounding the yarn from the surface in a continuous strand-like stream into a laterally extending zone within the bounce crimper unit, the filaments of the first yarn in said zone being entangled with each other and the first yarn being entangled with the second yarn, with filaments of the first yarn protruding laterally in loop configurations of bounce crimped filament sections; and (e) delivering the entangled rebounded yarn away from said zone and out of said unit without tensioning the yarn and while controlling the axial compression of the body of yarn exiting said zone.

7. A method according to claim 6 further comprising periodically slowing advancement of the second yarn in step (a) to cause periodic greater overfeed of the first yarn and resulting in periodic concentrations of the first yarn spaced along lengths of the entangled rebounded yarn.

8. A method according to claim 6 wherein the first yarn is selected from the group consisting of polypropylene and polyamide and prior to step (a) is drawn at a draw ratio between 2:1 and 5:1, wherein the second yarn is selected from the group consisting of polypropylene and polyamide.

9. A method of producing a thermoplastic multi-filament effect yarn, which method comprises:

(a) advancing first and second drawn multi-filament yarns longitudinally of themselves in a stream of heated fluid advancing longitudinally of the yarns in a bounce crimper unit, the first yarn being advanced at a rate of at least five times the rate of advance of the second yarn;

(b) hurling the yarns toward a foraminous surface within the bounce crimper unit by means of the stream of fluid while passing at least part of the stream of fluid through the foraminous surface;

(c) impinging the advancing yarns on the foraminous surface with sufficient force to induce a compression crimp in the filaments of at least the first yarn;

(d) instantaneously rebounding the yarn from the surface in a continuous strand-like stream into a laterally extending zone within the bounce crimper unit, the filaments of the first yarn in said zone being entangled with each other and the first yarn being entangled with the second yarn, with filaments of the first yarn protruding laterally in loop configurations of bounce crimped filament sections;

(e) delivering the entangled rebounded yarn away from said zone and out of said unit without tensioning the yarn and while controlling the axial compression of the body of yarn exiting said zone;

(f) setting said yarn in an untensioned condition; and (g) thereafter winding the yarn.

10. A method according to claim 9 further comprising periodically slowing advancement of the second yarn in step (a) to cause periodic greater overfeed of the first yarn and resulting in periodic concentrations of the first yarn spaced along lengths of the entangled rebounded yarn.

* * * * *